US012173717B2

(12) United States Patent
Hu et al.

(10) Patent No.: US 12,173,717 B2
(45) Date of Patent: Dec. 24, 2024

(54) COMPRESSOR

(71) Applicant: Gree Electric Appliances, Inc. of Zhuhai, Guangdong (CN)

(72) Inventors: Yusheng Hu, Guangdong (CN); Bin Chen, Guangdong (CN); Xiaobo Zhang, Guangdong (CN); Jinxin Jia, Guangdong (CN); Jiuzhan Su, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 100 days.

(21) Appl. No.: 18/011,671

(22) PCT Filed: May 7, 2021

(86) PCT No.: PCT/CN2021/092025
§ 371 (c)(1),
(2) Date: Dec. 20, 2022

(87) PCT Pub. No.: WO2022/062414
PCT Pub. Date: Mar. 31, 2022

(65) Prior Publication Data

US 2023/0250825 A1 Aug. 10, 2023

(30) Foreign Application Priority Data

Sep. 22, 2020 (CN) ..... 202011002421.X

(51) Int. Cl.
*F04D 17/10* (2006.01)
*F04D 25/06* (2006.01)
(Continued)

(52) U.S. Cl.
CPC ..... *F04D 17/10* (2013.01); *F04D 25/06* (2013.01); *F04D 25/08* (2013.01);
(Continued)

(58) Field of Classification Search
CPC .. F04D 17/10; F04D 29/0413; F04D 29/0473; F04D 29/0513; F04D 29/057;
(Continued)

(56) References Cited

U.S. PATENT DOCUMENTS 9,777,766 B1 * 10/2017 Bischof ..... F16C 17/026
2003/0059315 A1 * 3/2003 Choi ..... F04D 29/0513 417/371
(Continued)

FOREIGN PATENT DOCUMENTS

CN 104948478 A 9/2015
CN 204783801 U 11/2015
(Continued)

*Primary Examiner* — Kenneth J Hansen
(74) *Attorney, Agent, or Firm* — The Webb Law Firm

(57) ABSTRACT

A compressor includes a drive motor and a wind wheel, wherein the drive motor includes a casing and a rotor, the rotor being rotatably arranged within the casing; the wind wheel is mounted at a first axial end of the rotor. A thrust disc is also provided at the first axial end of the rotor. An axial bearing assembly is arranged between the thrust disc and the wind wheel, and the axial bearing assembly is arranged fixedly with respect to the casing. A first air gap is formed between a first end of the axial bearing assembly and the wind wheel, and a second air gap is formed between a second end of the axial bearing assembly and the thrust disc. The air compressor reduces a tolerance accumulation caused by part cooperation between axial bearing assemblies, and more precisely ensures effective working clearances.

18 Claims, 7 Drawing Sheets

(51) Int. Cl.

| | |
|---|---|
| ***F04D 25/08*** | (2006.01) |
| ***F04D 29/051*** | (2006.01) |
| ***F04D 29/08*** | (2006.01) |
| ***F04D 29/44*** | (2006.01) |
| ***F04D 29/58*** | (2006.01) |

(52) U.S. Cl.
CPC ..... *F04D 29/0513* (2013.01); *F04D 29/083* (2013.01); *F04D 29/441* (2013.01); *F04D 29/584* (2013.01)

(58) Field of Classification Search
CPC ..... F04D 29/20; F04D 29/266; F16C 17/107; F05D 2240/52
See application file for complete search history.

(56) References Cited

U.S. PATENT DOCUMENTS

2011/0243762 A1 10/2011 Daikoku et al.
2014/0050575 A1* 2/2014 Kim ..... F04D 29/0513 415/203
2016/0298648 A1 10/2016 Graham et al.
2023/0014246 A1* 1/2023 Liu ..... F25B 1/053

FOREIGN PATENT DOCUMENTS

| | | | |
|---|---|---|---|
| CN | 106321498 | A | 1/2017 |
| CN | 109751255 | A | 5/2019 |
| CN | 208871909 | U | 5/2019 |
| CN | 209324516 | U | 8/2019 |
| CN | 110199129 | A | 9/2019 |
| CN | 209340161 | U | 9/2019 |
| CN | 110382888 | A | 10/2019 |
| CN | 209704930 | U | 11/2019 |
| CN | 209781242 | U | 12/2019 |
| CN | 210164664 | U | 3/2020 |
| CN | 210461110 | U | 5/2020 |
| CN | 111271304 | A | 6/2020 |
| CN | 111279086 | A | 6/2020 |
| CN | 211370767 | U | 8/2020 |
| CN | 112160915 | A | 1/2021 |
| JP | 2007162492 | A | 6/2007 |
| WO | 2020134433 | A1 | 7/2020 |

* cited by examiner

COMPRESSOR

CROSS-REFERENCE TO RELATED APPLICATIONS

This application is the United States national phase of International Application No. PCT/CN2021/092025 filed May 7, 2021, and claims priority to Chinese Patent Application No. 202011002421.X filed on Sep. 22, 2020, the disclosures of which are hereby incorporated by reference in their entireties.

BACKGROUND OF THE INVENTION

Field of the Invention

The present disclosure relates to the field of air compression technology, in particular to a compressor.

Description of Related Art

In the process of variable frequency adjustment of a centrifugal compressor, an outlet pressure gradually increases with the increase of power. After gas is compressed by the centrifugal compressor, a high pressure is formed in a pneumatic cavity, and a pressure difference is formed between the high pressure at the back of an impeller and the atmospheric pressure at an intake port, such that an axial force forward along the impeller is produced in an entire shaft system.

To this end, a relevant air suspension centrifugal compressor uses dual radial air suspension bearings and dual axial air suspension bearings to operate with support of five degrees of freedom, wherein front and rear radial bearings are distributed on two sides of a motor stator, and front and second axial bearings are distributed on two sides of a thrust disc. The requirement on an effective working clearance between an axial air suspension bearing during operation and a thrust surface is very strict. The effective working clearance is basically in the order of μm. This directly influences the load-bearing performance and bearing life of the axial air suspension bearing. A compressor integration solution adopted has strict requirements on the thickness of the thrust disc, and the sizes of positioning step surfaces of the front and second axial bearing assemblies, in order to ensure the effective working clearance of the axial air suspension bearing. However, assembling too many parts results in a tolerance accumulation, such that the effective working clearance of the axial air suspension bearing cannot be guaranteed.

SUMMARY OF THE INVENTION

The present disclosure provides a compressor including a drive motor and a wind wheel, wherein the drive motor includes a casing and a rotor, the rotor being rotatably arranged within the casing; the wind wheel is mounted at a first axial end of the rotor; a thrust disc is also provided at the first axial end of the rotor; an axial bearing assembly is arranged between the thrust disc and the wind wheel, and the axial bearing assembly is arranged fixedly with respect to the casing; and an air gap is formed between a first end of the axial bearing assembly and the wind wheel, and an air gap is formed between a second end of the axial bearing assembly and the thrust disc.

In some embodiments, the axial bearing assembly includes an annular fixing seat, and an annular bearing seat is arranged on an inner peripheral wall of the fixing seat; a first axial bearing is arranged at a first end of the bearing seat, and a second axial bearing is arranged at a second end of the bearing seat; and an air gap is formed between the first axial bearing and the wind wheel, and an air gap is formed between the second axial bearing and the thrust disc.

In some embodiments, the first end of the bearing seat cooperates with the inner peripheral wall of the fixing seat to form a first annular slot, and the first axial bearing is mounted in the first annular slot.

In some embodiments, the wind wheel is at least partially mounted into the first annular slot and is in annular seal fit with the inner peripheral wall of the fixing seat.

In some embodiments, the second end of the bearing seat cooperates with the inner peripheral wall of the fixing seat to form a second annular slot, and the second axial bearing is mounted in the second annular slot.

In some embodiments, the diameter of the thrust disc is smaller than or equal to the diameter of the second annular slot; and/or the thrust disc is at least partially mounted in the second annular slot.

In some embodiments, a radial displacement sensor is provided on the inner peripheral wall of the fixing seat, corresponding to the thrust disc.

In some embodiments, the wind wheel includes an axial flange projecting towards the thrust disc, and the thrust disc includes a first positioning surface facing the axial bearing assembly; and the axial flange is arranged on an inner peripheral side of the axial bearing assembly, and a positioning end side of the axial flange facing the thrust disc abuts against the first positioning surface.

In some embodiments, a mounting shaft is provided at the first axial end of the rotor, and the wind wheel is mounted to the mounting shaft.

In some embodiments, a positioning boss is further provided at the first axial end of the rotor; the mounting shaft is located on the positioning boss; the diameter of the positioning boss is smaller than the diameter of the rotor, and the diameter of the mounting shaft is smaller than the diameter of the positioning boss; and the thrust disc is mounted on the positioning boss, and the thickness of the positioning boss is smaller than the thickness of the thrust disc.

In some embodiments, the wind wheel is enclosed by a volute outside, and an impeller diffuser is provided on a side of the fixing seat facing the volute; and the impeller diffuser cooperates with the volute to form pneumatic flow channels.

In some embodiments, the impeller diffuser is a vaneless diffuser, and the fixing seat is provided with a mounting step, on which the volute is mounted.

In some embodiments, cooling flow channels are formed in the axial bearing assembly, the cooling flow channels including a first fluid passage port, a second fluid passage port and circulating holes, the first fluid passage port and the second fluid passage port being communicated through the circulating holes.

In some embodiments, in the case the axial bearing assembly includes a fixing seat and a bearing seat, the first fluid passage port and the second fluid passage port are provided in the fixing seat, and the circulating holes pass through the fixing seat and/or the bearing seat.

In some embodiments, a plurality of circulating holes are provided; the plurality of the circulating holes are communicated with the first fluid passage port through a first communicating channel, and the plurality of the circulating holes are communicated with the second fluid passage port through a second communicating channel; and the first communicating channel and the second communicating channel are isolated from each other.

In some embodiments, the first fluid passage port extends axially of the fixing seat, and the second fluid passage port extends axially of the fixing seat; the circulating holes extend radially of the fixing seat; and the first communicating channel is provided on an outer peripheral side of the fixing seat, and the second communicating channel is provided on the outer peripheral side of the fixing seat.

In some embodiments, the first communicating channel is located on an outer peripheral side of the circulating holes and extends circumferentially of the fixing seat; the second communicating channel is located on the outer peripheral side of the circulating hole and extends circumferentially of the fixing seat; and the first communicating channel is located at a first end of a diameter of the fixing seat, and the second communicating channel is located at a second end of the diameter.

In some embodiments, the first communicating channel forms an open slot in an outer peripheral face of the fixing seat, and/or the second communicating channel forms an open slot in the outer peripheral face of the fixing seat.

In some embodiments, the circulating holes are V-shaped, arc-shaped or linear.

In some embodiments, radial air bearings are provided at two ends of the rotor, respectively, and the rotor is rotatably sleeved in the radial air bearings.

In some embodiments, the radial air bearing located at the first end of the rotor is arranged on a side of the thrust disc away from the axial bearing assembly, and an axial displacement sensor is arranged on an end side of the radial air bearing facing the thrust disc.

The present disclosure provides a compressor including a drive motor and a wind wheel, wherein the drive motor includes a casing and a rotor, the rotor being rotatably arranged within the casing; the wind wheel is mounted at a first end of the rotor; a thrust disc is also provided at the first end of the rotor; an axial bearing assembly is arranged between the thrust disc and the wind wheel, and the axial bearing assembly is arranged fixedly with respect to the casing; and an air gap is formed between a first end of the axial bearing assembly and the wind wheel, and an air gap is formed between a second end of the axial bearing assembly and the thrust disc. In the case of the compressor, the axial bearing assembly is mounted between the thrust disc and the wind wheel, so that axial end sides of the thrust disc and the wind wheel facing the axial bearing assembly form thrust surfaces; furthermore, a front axial bearing assembly and a rear axial bearing assembly are arranged, in a back-to-back form, in one axial bearing assembly, so that the measurement of the distance between two bearing surfaces of the front axial bearing assembly and the rear axial bearing assembly is easier and more accurate, and precise control of the distance between the two bearing surfaces is achieved; therefore, in designing of the air gaps, when the spacing between the thrust disc and the wind wheel needs to be guaranteed, and precise adjustment of the air gap between the axial bearing assembly and the thrust disc and the air gap between the axial bearing assembly and the wind wheel is achieved, which involves fewer positioning parameters and fewer parts, resulting in a smaller tolerance accumulation by assembly of the parts, thus reducing a tolerance accumulation caused by part cooperation between axial bearing assemblies, and ensuring effective working clearances more precisely.

Figure 1:
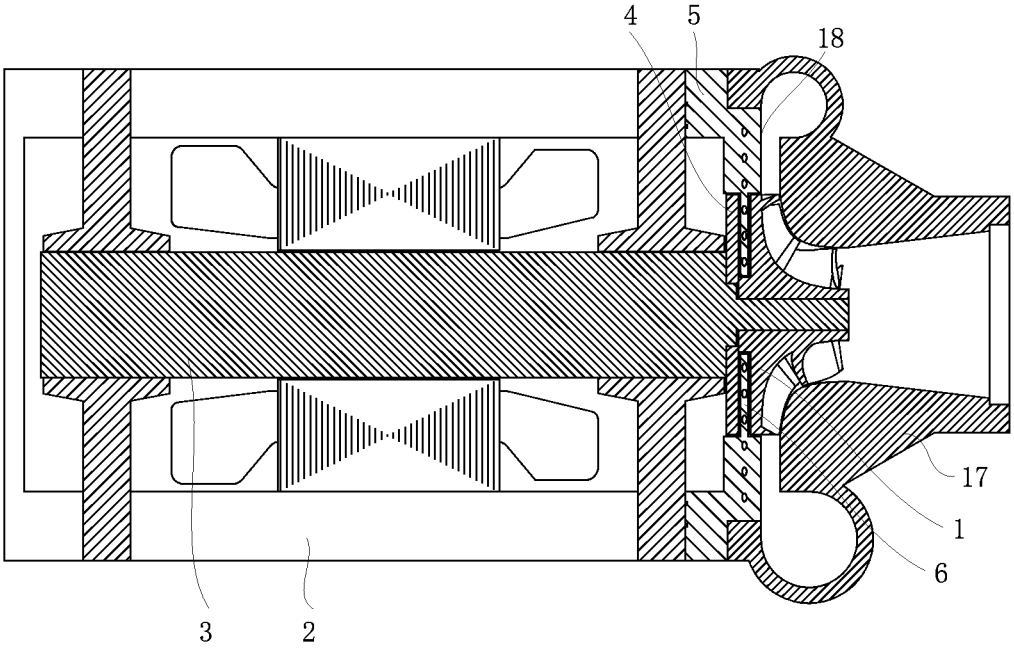
FIG. 1 is a cross-sectional structural diagram of a compressor provided in some embodiments of the present disclosure.
Figure 2:
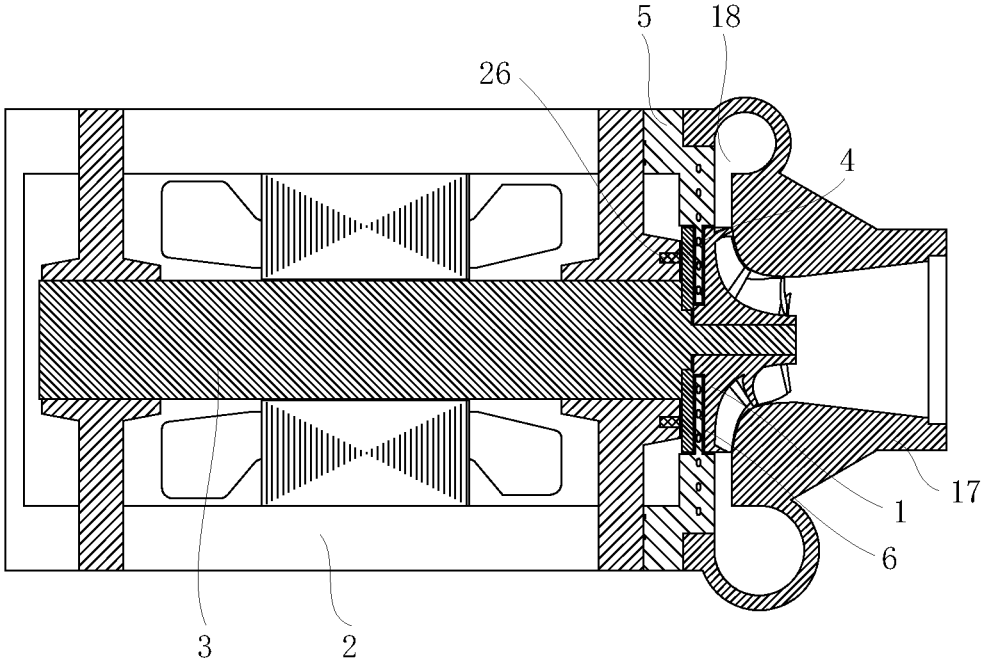
FIG. 2 is a cross-sectional structural diagram of a compressor provided in some other embodiments of the present disclosure.

Reference signs: 1, wind wheel; 2, casing; 3, rotor; 4, thrust disc; 5, fixing seat; 6, bearing seat; 7, first axial bearing; 8, second axial bearing; 9, first annular slot; 10, second annular slot; 11, radial displacement sensor; 12, axial flange; 13, first positioning surface; 14, positioning end side; 15, mounting shaft; 16, positioning boss; 17, volute; 18, impeller diffuser; 19, mounting step; 20, first fluid passage port; 21, second fluid passage port; 22, circulating hole; 23, first communicating channel; 24, second communicating channel; 25, radial air bearing; 26, axial displacement sensor; 27, drive motor; 28, axial bearing assembly

DESCRIPTION OF THE INVENTION

Referring to FIGS. 1 to 13 in combination, according to embodiments of the present disclosure, a compressor includes a drive motor and a wind wheel 1, the drive motor including a casing 2 and a rotor 3. The rotor 3 is rotatably arranged within the casing 2; the wind wheel 1 is mounted at a first axial end of the rotor 3; and a thrust disc 4 is also provided at the first axial end of the rotor 3. An axial bearing assembly 28 is arranged between the thrust disc 4 and the wind wheel 1, and the axial bearing assembly 28 is arranged fixedly with respect to the casing 2. A first air gap is formed between a first end of the axial bearing assembly 28 and the wind wheel 1, and a second air gap is formed between a second end of the axial bearing assembly 28 and the thrust disc 4.

In the case of the compressor, the axial bearing assembly 28 is mounted between the thrust disc and the wind wheel 1, so that axial end sides of the thrust disc and the wind wheel 1 facing the axial bearing assembly 28 form thrust surfaces; furthermore, the first axial bearing 7 and the second axial bearing 8 are arranged, in a back-to-back form, in one axial bearing assembly 28, and the thrust surfaces of the thrust disc and the wind wheel 1 cooperate with the one axial bearing assembly 28 to implement axial limiting, so that the measurement of the distance between two bearing surfaces of the first axial bearing 7 and the second axial bearing 8 is easier and more accurate, and precise control of the distance between the two bearing surfaces is achieved; in designing of the first air gap and the second air gap, precise adjustment of the first air gap and the second air gap is achieved by controlling the spacing between the thrust disc and the wind wheel 1, which involves fewer positioning parameters and fewer parts, resulting in a smaller tolerance accumulation by assembly of the parts, thus reducing a tolerance accumulation caused by part cooperation between axial bearing assemblies 28, and allowing more precise adjustment of effective working clearances.

The axial bearing assembly 28 includes a fixing seat 5, a bearing seat 6, a first axial bearing 7 and a second axial bearing 8.

The axial bearing assembly 28 includes a bearing mounting seat, which includes the annular fixing seat 5 and the annular bearing seat 6. The annular bearing seat 6 is arranged on an inner peripheral wall of the fixing seat 5; a first axial bearing 7 is arranged at a first end of the bearing seat 6, and a second axial bearing 8 is arranged at a second end of the bearing seat 6; and the first air gap is formed between the first axial bearing 7 and the wind wheel 1, and the second air gap is formed between the second axial bearing 8 and the thrust disc 4.

In some embodiments, the first axial bearing 7 and the second axial bearing 8 are integrated on the same bearing seat 6. One bearing seat 6 is used to implement suspension control in two axial directions, and the back of the wind wheel 1 is used as a thrust surface, the thrust surface of the thrust disc 4 cooperates with the thrust surface of the wind wheel 1 to form two thrust surfaces for axial limiting, thus reducing the number of the axial bearing assembly 28, simplifying the structure of the axial bearing assembly 28, and also reducing the overall axial thickness of the axial bearing assembly 28, which reduces the axial length of the rotor 3, and avoids problems such as a decreased natural frequency and an insufficient design allowance of a rotator shaft system due to too large an axial length of the shaft system, and an increased volume of an air compressor due to too large a length of the rotor.

Figure 3:
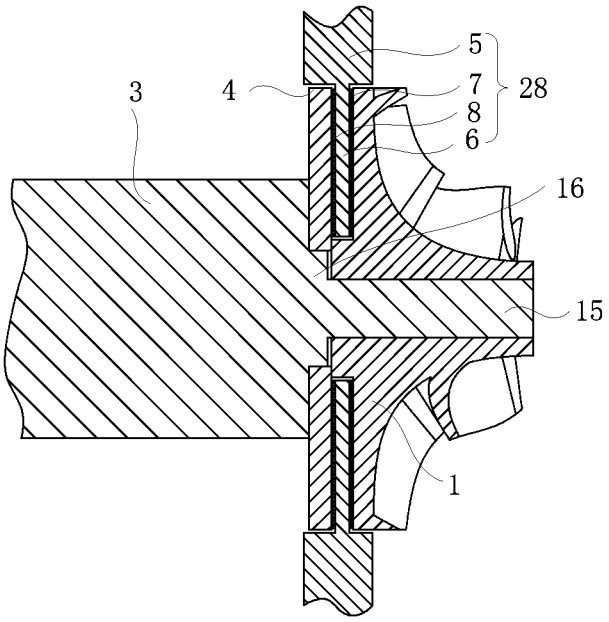
FIG. 3 is an enlarged structural diagram of FIG. 1 at a mounting position for an axial bearing assembly.
Figure 4:
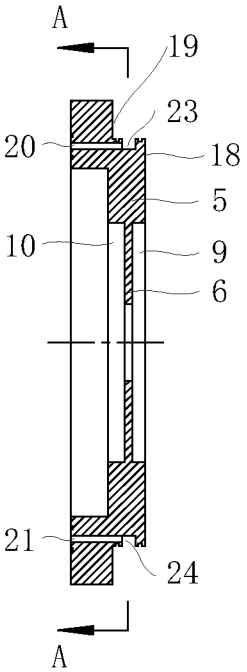
FIG. 4 is a cross-sectional structural diagram of an axial bearing assembly of a compressor in some embodiments of the present disclosure.
Figure 5:
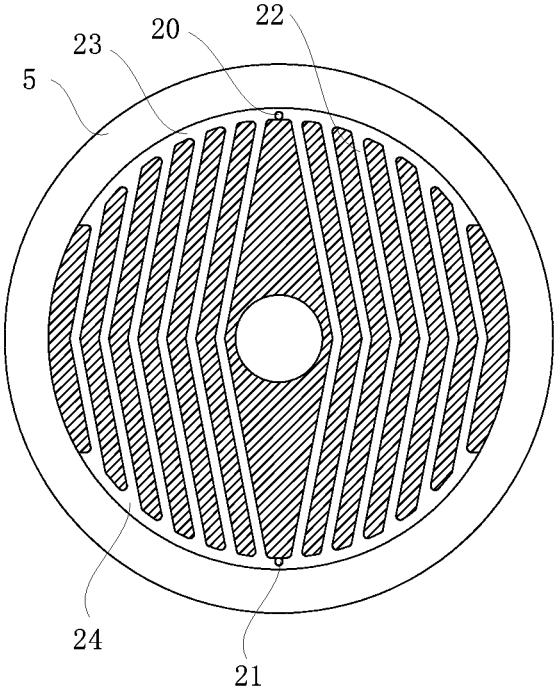
FIG. 5 is a cross-sectional structural diagram of FIG. 4 along A-A.
Figure 6:
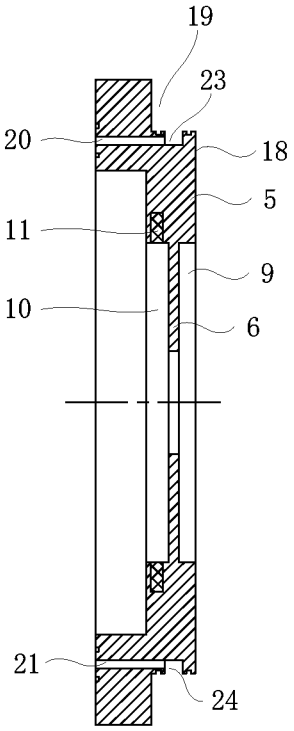
FIG. 6 is a cross-sectional structural diagram of an axial bearing assembly of a compressor provided in some other embodiments of the present disclosure.
Figure 7:
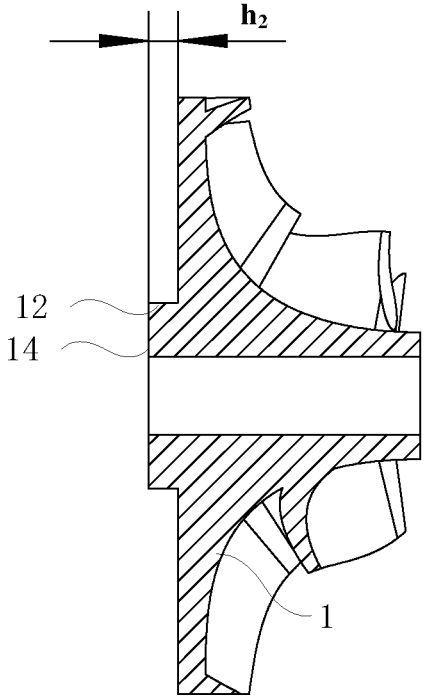
FIG. 7 is a cross-sectional structural diagram of a wind wheel of a compressor provided in some embodiments of the present disclosure.
Figure 8:
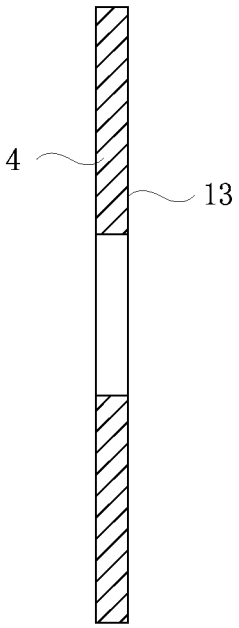
FIG. 8 is a cross-sectional structural diagram of a thrust disc of a compressor provided in some embodiments of the present disclosure.
Figure 9:
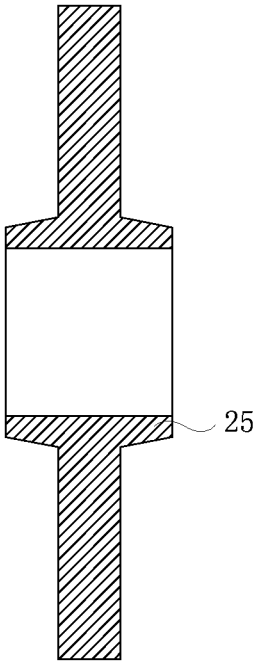
FIG. 9 is a cross-sectional structural diagram of a radial air bearing of a compressor provided in some embodiments of the present disclosure.
Figure 10:
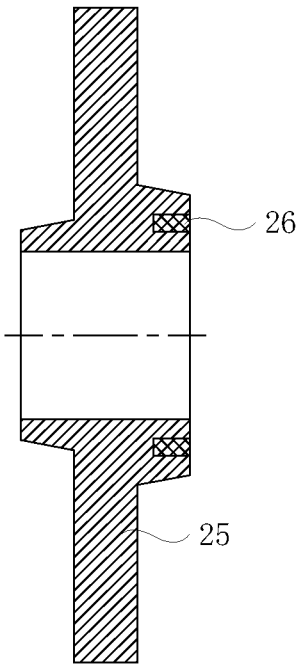
FIG. 10 is a cross-sectional structural diagram of a radial air bearing of a compressor provided in some other embodiments of the present disclosure.
Figure 11:
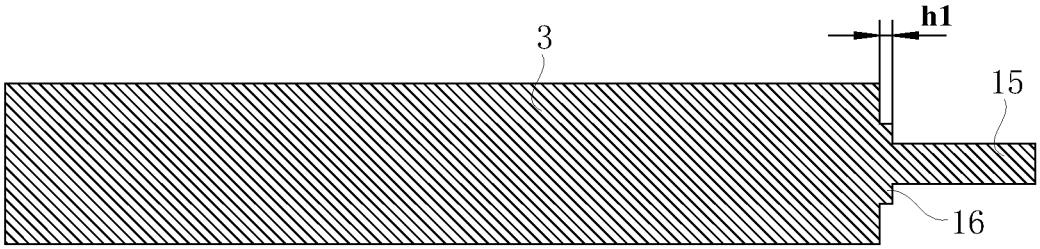
FIG. 11 is a cross-sectional structural diagram of a rotor of a compressor provided in some embodiments of the present disclosure.

Referring to FIGS. 3 and 4, an axial dimension of the bearing seat 6 is smaller than an axial dimension of the fixing seat 5, and the bearing seat 6 is located in the middle of the fixing seat 5 in the axial direction, so that in the axial direction of the bearing seat 6, the bearing seat 6 and the fixing seat 5 form two annular slots: a first annular slot 9 and a second annular slot 10. The first end of the bearing seat 6 cooperates with the inner peripheral wall of the fixing seat 5 to form the first annular slot 9, and the first axial bearing 7 is mounted in the first annular slot 9. The second end of the bearing seat 6 cooperates with the inner peripheral wall of the fixing seat 5 to form the second annular slot 10, and the second axial bearing 8 is mounted in the second annular slot 10.

The bearing seat is arranged between the first axial bearing 7 and the second axial bearing 8 in a spaced manner, so that operations of the first axial bearing 7 and the second axial bearing 8 do not interfere with each other, and the bearing seat 6 also cooperates with the fixing seat 5 to form the annular slots for mounting the first axial bearing 7 and the second axial bearing 8, which facilitates installation and fixation of the first axial bearing 7 and the second axial bearing 8.

The wind wheel 1 is at least partially mounted into the first annular slot 9 and is in annular seal fit with the inner peripheral wall of the fixing seat 5, so that the fixing seat 5 forms an annular seal with the wind wheel 1. At least partially mounting the wind wheel 1 into the first annular slot 9 reduces the axial space of the rotor 3 occupied by the wind wheel 1, so that the entire structure of the rotor 3 in the axial direction is more compact.

In the air compressor, a side where the wind wheel 1 runs at a high speed to compress gas is a high-pressure gas side, i.e., a pneumatic part, while a side driving the wind wheel 1 to rotate at a high speed is a low-pressure gas side, i.e., a motor side. As is well known, to ensure that the performance of the compressor meets the required standard, in addition well designing the overall solution of the compressor, it also needs to control the amount of leaked compressed gas, i.e., to control the amount of high-pressure gas leaked from the high-pressure side to the low-pressure side during operation of the compressor. In order to effectively inhibit the leakage of the high-pressure gas on the high-pressure gas side, in some embodiments, an annular sealing position is designed between an annular peripheral wall of the first annular slot 9 and an outer peripheral wall of the wind wheel 1. The annular sealing position is used to arrange an annular seal. In some embodiments, the annular seal is a part which is assembled. In other embodiments, the annular seal is machined directly after an allowance is reserved at the annular seal position. There are various implementations of the sealing structural form of the annular seal, and its structure and design are related to use requirements. The provided annular seal cooperates with an annular sealing surface formed by the outer peripheral wall of the wind wheel 1 or an annular sealing surface formed by the annular peripheral wall of the first annular slot 9 to form the entire annular sealing structure.

The annular seal is mounted on an outer peripheral face of the wind wheel 1 or on an inner peripheral face of the annular perimeter wall of the first annular slot 9. The specific structural form of the annular seal is, for example, a comb tooth structure, in which a sealing filler is filled, and an annular rotary seal between the wind wheel 1 and the fixing seat 5 is achieved by the sealing filler.

In some embodiments, the diameter of the thrust disc 4 is smaller than or equal to the diameter of the second annular slot 10. The thrust disc 4 is at least partially mounted in the second annular slot 10 to enable the thrust disc 4 to be mounted into the second annular slot 10, thereby saving an axial space of the rotor 3, and shortening the required axial length of the rotor 3, so that the compressor is more compact in structure. In some embodiments, the distance between an open end side of the second annular slot 10 and the bearing surface of the second axial bearing 8 is greater than the sum of an axial thickness of the thrust disc 4 and the air gap, and the thrust disc 4 is entirely mounted into the second annular slot 10.

When integrated assembly of the complete compressor structure is carried out, a rotating shaft of the rotor needs to be considered, and the inner diameter of the axial bearing assembly 28 should not be smaller than the diameter of the radial air bearing rotor. In a shaft system solution in the related art, an axial bearing assembly is provided at each of two ends of a thrust disc, respectively, to axially limit the thrust disc. In addition to the aforementioned problem that a serious tolerance accumulation resulting from more assembly parts is liable to cause the effect that accuracy cannot be guaranteed, in this structure, due to the rotor structure, the inner diameter of the axial bearing assembly should not be smaller than the diameter of the radial air bearing rotor, and thus the thrust disc located on the inner side of an outer circle of the rotor is not involved in an cooperating area with the second axial bearing, so in order to have a sufficient cooperating area between the thrust disc and the axial bearing, the diameter of the thrust disc is increased, such that the designed size of the thrust disc of the rotator shaft system is also greater.

In designing of a high-speed or even ultra-high-speed rotor shaft system solution, the smaller the outer diameter for assembling parts, the higher the designed strength of the parts, the more helpful to modal improvement of the rotator shaft system, so the designed outer diameter of the thrust disc is destined not to be very small due to the limitation of the rotor diameter.

Figure 12:
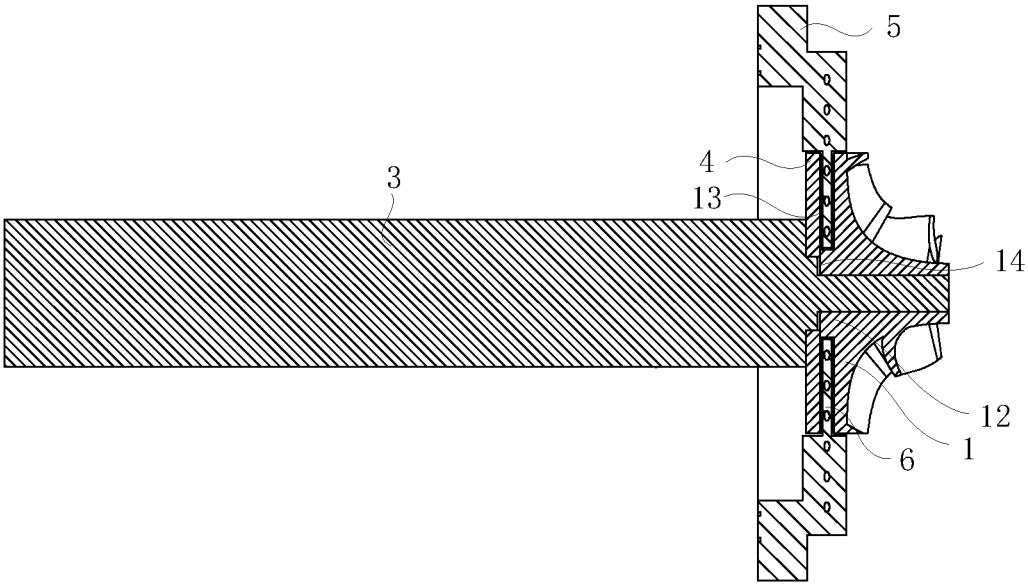
FIG. 12 is an assembly diagram of a rotor, a wind wheel and an axial bearing assembly of a compressor provided in some embodiments of the present disclosure.
Figure 13:
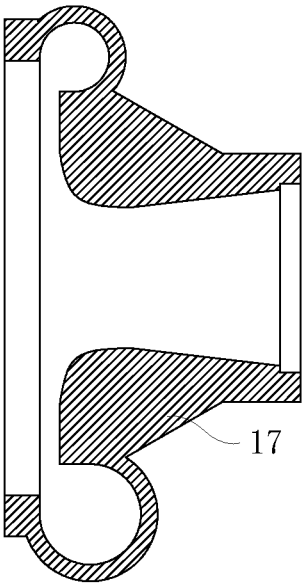
FIG. 13 is a cross-sectional structural diagram of a volute of a compressor provided in some embodiments of the present disclosure.

In the technical solution of the present disclosure, back-to-back arrangement of the first axial bearing 7 and the second axial bearing 8 is implemented by using one axial bearing assembly 28, wherein the first axial bearing 7 is mounted in the first annular slot 9 described later and the second axial bearing is mounted in the second annular slot 10. The first axial bearing 7 and the second axial bearing 8 are both placed between the thrust disc 4 and the wind wheel 1. During assembly, first, the rotor with the thrust disc 4 is placed vertically, then the bearing mounting seat for axial bearings in the middle, installed with the first axial bearing 7 and the second axial bearing 8, is placed onto the thrust disc 4, and then the wind wheel 1 is assembled to the rotor and locked to form an integral assembly. Then the rotating shaft is assembled, as shown in FIG. 12. In this way, the rotating shaft of the rotor does not need to pass through the first axial bearing 7 and the second axial bearing 8, and the first axial bearing 7 and the second axial bearing 8 do not need to be designed with greater sizes in order to avoid the rotor. Thus, the design of small sizes of parts of the shaft system is achieved, and modal performance and a safety allowance of the overall shaft system are guaranteed.

A radial displacement sensor 11 is provided on the inner peripheral wall of the fixing seat 5, corresponding to the thrust disc 4, and a radial displacement of the rotor 3 is detected by means of the thrust disc 4.

The wind wheel 1 includes an axial flange 12 projecting towards the thrust disc 4, and the thrust disc 4 includes a first positioning surface 13 facing the axial bearing assembly 28; and the axial flange 12 is arranged on an inner peripheral side of the axial bearing assembly 28, and a positioning end side 14 of the axial flange 12 facing the thrust disc 4 abuts against the first positioning surface 13. The axial flange 12 protrudes from the thrust surface of the wind wheel 1 and projects towards the thrust surface of the thrust disc 4, i.e., the first positioning surface 13, thus ensuring the spacing between the positioning end side 14 of the axial flange 12 and the first positioning surface 13, thereby achieving precise adjustment of the cooperating air gap of the axial bearing assembly 28, which is simpler in design and more convenient in implementation.

A mounting shaft 15 is provided at the first axial end of the rotor 3, and the wind wheel 1 is mounted to the mounting shaft 15. A positioning boss 16 is further provided at the first axial end of the rotor 3. The mounting shaft 15 is located on the positioning boss 16; the diameter of the positioning boss 16 is smaller than the diameter of the rotor 3, and the diameter of the mounting shaft 15 is smaller than the diameter of the positioning boss 16; and the thrust disc 4 is mounted on the positioning boss 16, and an axial height h1 of the positioning boss 16 is smaller than the thickness of the thrust disc 4, so that the first positioning surface 13 of the thrust disc 4 is higher than an end side of the positioning boss 16, to avoid interference of the positioning boss 16 with the cooperation of the first positioning surface 13 and the positioning end side 14.

In the air bearing supported compressor, the assembly adjustment of effective working clearances of the axial bearing assembly 28 is one of the most important processes. The first axial bearing 7 is mounted at a first axial bearing mounting position of the mid-mounted bearing mounting seat, and the second axial bearing 8 is mounted at a second axial bearing mounting position, to achieve that the two axial bearing assemblies 28, which would have been placed on two sides of the thrust disc 4 and mounted on two parts, respectively, are arranged back to back on one part, such that the measurement of the distance between the bearing surface of the first axial bearing 7 and the bearing surface of the second axial bearing 8 after installation is easier and more accurate, wherein the second axial bearing 8 forms an effective working clearance with the thrust surface of the thrust disc 4, and the first axial bearing 7 forms an effective working clearance with the thrust surface of the wind wheel 1.

The two axial bearing thrust surfaces are distributed on the thrust disc 4 and the wind wheel 1, respectively. The wind wheel 1 is made of, for example, an alloy steel material to carry the bearing. In some embodiments, from the perspective of light weight, on the bearing surface, a wear-resistant alloy steel material is added to serve as the bearing surface. The thrust disc 4 is made of an alloy steel material. The effective working clearances between the thrust surface of the wind wheel 1 and the thrust surface of the thrust disc 4 and the air axial bearings are determined by the first positioning surface 13 of the thrust disc 4 and the axial flange height h2 of the wind wheel 1. A certain allowance is reserved for the axial flange 12 when the wind wheel 1 is machined. Since both the thrust disc 4 and the wind wheel 1 are precision machined parts, after the distance between the two bearing surfaces of the axial bearing assembly 28 is accurately measured and the effective working clearances of the axial bearings are added, the height h2 of the axial flange is machined properly, and the axial height h1 of the positioning boss 16 of the rotating shaft is made smaller than the thickness of the thrust disc 4. An outer peripheral face of the positioning boss 16 serves as a thrust disc assembly surface. An end side of the first end of the rotor serves as a thrust disc positioning surface, and an outer peripheral face of the mounting shaft 15 serves as an impeller assembly surface. The machining precision of each assembly surface should be within the required range. An inner circle portion of the thrust surface of the thrust disc 4 also serves as a mounting positioning surface for the axial flange 12 of the wind wheel 1. By assembling the rotor 3, the thrust disc 4, the axial bearing assembly 28 and the wind wheel 1 in this sequence, the assembly of the complete shaft system can be accomplished, and the effective working clearances of the axial bearing assembly 28 are precisely adjusted by machining of one dimension of one part (machining of the axial flange height h2 of the wind wheel 1), which not only optimizes and simplifies the machining process of the parts, but also simplifies the assembly method and the adjustment method, and greatly improves the process flow.

The wind wheel 1 is enclosed by a volute 17 outside, and an impeller diffuser 18 is provided on a side of the fixing seat 5 facing the volute 17. The impeller diffuser 18 cooperates with the volute 17 to form pneumatic flow channels. The impeller diffuser includes a vaned diffuser and a vaneless diffuser. In some embodiments, the impeller diffuser 18 is a vaneless diffuser, and the fixing seat 5 is provided with a mounting step 19, and the volute 17 is mounted on the mounting step 19.

The mid-mounted bearing mounting seat is machined with a machining allowance reserved in the axial direction for machining the impeller diffuser 18. The impeller diffuser 18 needs to be combined with the volute 17 to form complete flow channels, so in a split design, the diffuser is designed as a plane, and complex structures are implemented in the volute 17, and thus the vaneless diffuser only needs to be machined into a plane, and then the impeller diffuser 18 and volute 17 are assembled and combined to form complete pneumatic flow channels.

Cooling flow channels are formed in the axial bearing assembly 28, the cooling flow channels including a first fluid passage port 20, a second fluid passage port 21 and circulating holes 22, the first fluid passage port 20 and the second fluid passage port 21 being communicated through the circulating holes 22. The cooling flow channels are filled with a cooling fluid to cool the axial bearing assembly 28.

In some embodiments, as a front axial bearing assembly and a rear axial bearing assembly are united to form one axial bearing assembly 28, thus the overall thickness of the fixing seat 5 for mounting the axial bearing assembly 28 is increased without increasing the axial length of the axial bearing assembly 28, so that both the fixing seat 5 and the bearing seat 6 have sufficient axial thicknesses to provide the cooling flow channels, which facilitates the design of a cooling system.

When the compressor operates at a high speed, the working clearance between the thrust disc 4 and the axial bearing assembly 28 is very small, generally in the order of μm. High-speed friction between the high-pressure air in such a small clearance and the surface of the axial bearing assembly 28 and the surface of the thrust disc 4 generates a lot of heat, and the too small working clearance is not conducive to heat dissipation from the surface of the axial bearing assembly 28 and the surface of the thrust disc 4. After being heated, the axial bearing assembly 28 and thrust disc 4 are deformed by thermal expansion in the axial direction, and an excessively high temperature results in that the working clearance is completely squeezed out by the amount of thermal expansion of the axial bearing assembly 28, and locking occurs. Sudden locking of the rotor in high-speed rotation renders the entire compressor useless. If a foil-type axial bearing assembly 28 is adopted, there is also a layer of wear-resistant lubricating coating on its surface, and an excessively high temperature may cause the wear-resistant lubricating coating to fail or even fall off, which also causes serious damage to the compressor.

In order to cope with the above possibilities and reduce the temperature of the axial bearing assembly 28 during operation, the present disclosure provides cooling flow channels in the mid-mounted bearing mounting seat to dissipate the heat generated during the operation of the axial bearing assembly 28 and the thrust disc 4 by means of the cooling fluid in the cooling flow channels, thereby effectively reducing the temperature of the axial bearing assembly 28 during operation.

In some embodiments, the first fluid passage port 20 and the second fluid passage port 21 are provided in the fixing seat 5, and the circulating holes 22 pass through the fixing seat 5 and/or the bearing seat 6. In some embodiments, the first fluid passage port 20 and the second fluid passage port 21 are provided in the fixing seat 5, and the circulating holes 22 pass through the fixing seat 5 and the bearing seat 6, thereby effectively cooling the entire bearing mounting seat and reducing the temperature of the bearing mounting seat during operation.

A plurality of circulating holes 22 are provided. The plurality of the circulating holes 22 are communicated with the first fluid passage port 20 through a first communicating channel 23, and the plurality of the circulating holes 22 are communicated with the second fluid passage port 21 through a second communicating channel 24. The first communicating channel 23 and the second communicating channel 24 are isolated from each other. The first communicating channel 23 and the second communicating channel 24 are communicated only through the circulating holes 22, so that the cooling fluid cannot enter the second communicating channel 24 directly through the first communicating channel 23 or enter the first communicating channel 23 through the second communicating channel 24. Only after arriving at one of the communicating channels from a fluid inlet, the cooling fluid is distributed by the communicating channel, so that the cooling fluid evenly enters each of the circulating holes 22, then flows from the circulating holes 22 to the other communicating channel, and flows out from a fluid outlet after converging through the other communicating channel, thus achieving cooling of the bearing mounting seat.

The first fluid passage port 20 extends axially of the fixing seat 5, and the second fluid passage port 21 extends axially of the fixing seat 5; the circulating holes 22 extend radially of the fixing seat 5; and the first communicating channel 23 is provided on an outer peripheral side of the fixing seat 5, and the second communicating channel 24 is provided on the outer peripheral side of the fixing seat 5. In some other embodiments, the first fluid passage port 20 and the second fluid passage port 21 extend in the radial direction; and the first communicating channel 23 extends circumferentially, and the second communicating channel 24 extends circumferentially, so that the first fluid passage port 20, the first communicating channel 23, the circulating holes 22, the second communicating channel 24, and the second fluid passage port 21 are communicated to achieve the design of the cooling flow channels.

The first communicating channel 23 is located on an outer peripheral side of the circulating holes 22 and extends circumferentially of the fixing seat 5; the second communicating channel 24 is located on the outer peripheral side of the circulating hole 22 and extends circumferentially of the fixing seat 5; and the first communicating channel 23 is located at a first end of a diameter of the fixing seat 5, and the second communicating channel 24 is located at a second end of the diameter, so that the circulating holes 22 pass through the bearing mounting seat to the maximum extent and cool the entire bearing mounting seat more effectively, thereby improving the cooling effect.

In some embodiments, the first communicating channel 23 forms an open slot in an outer peripheral face of the fixing seat 5, and the second communicating channel 24 forms an open slot in the outer peripheral face of the fixing seat 5, which facilitates machining of the communicating channels. The communicating channels are provided on the mounting step 19 of the fixing seat 5. During installation, the volute 17 is fixedly arranged on the mounting step 19 after machining of the communicating channels is completed. Sealing of the first communicating channel 23 and the second communicating channel 24 is achieved by a cooperating mounting surface of the volute 17. In order to improve the sealing effect, a seal ring, a sealing groove or the like is provided on two sides of the first communicating channel 23 and the second communicating channel 24.

The circulating holes 22 are V-shaped, arc-shaped or linear. The above-mentioned shapes are formed by machining, using a simple machining method at a low machining cost. In some other embodiments, other forming methods are used to process the structures of different circulating holes 22, such as serpentine circulating holes 22 or zigzag circulating holes 22.

Radial air bearings 25 are provided at two ends of the rotor 3, respectively, and the rotor 3 is rotatably sleeved in the radial air bearings 25; the radial air bearings 25 are fixed to the casing 2; and the fixing seat 5 is fixedly mounted to the radial air bearings 25.

The fluid passage ports in the fixing seat 5 are communicated with fluid channels formed beforehand at corresponding positions in the liquid-cooled casing 2 and radial air bearings 25 of the embodiments, the compressor; sealing between outer holes of the fluid passage ports and end sides of the radial air bearing 25 is implemented by sealing grooves in combination with rubber rings to prevent leakage; inner holes of the fluid passage ports are communicated with the communicating channels, and the communicating channel are then communicated with all the circulating holes 22, to form a complete cooling cycle structure, wherein the communicating channels are designed as annular semi-open cooling channels to facilitate machining, and the sealing grooves on the two sides of the communicating channels are used in combination with the rubber rings as well as the annular sealing surface of the volute 17 to form complete closed cooling flow channels to prevent the cooling fluid from leaking in the mid-mounted bearing mounting seat.

Referring to FIGS. 1 and 4 in combination, in placement of the complete compressor, the compressor is placed and fixed in a direction where the rotor is horizontal, with a fluid passage port at the bottom serving as a fluid inlet and a fluid passage port at the top serving as a fluid outlet, so as to use the pressure of the complete compressor cooling system to press in the cooling fluid through the fluid inlet at the bottom of the mid-mounted bearing mount, so that the cooling fluid is filled into the entire cooling flow channels and then is pressed out through the fluid outlet. This ensures full contact between the cooling fluid and the cooling flow channels to carry away, to the maximum extent, the heat generated by the axial bearing assembly 28 during operation, and to achieve maximum cooling of the axial bearing assembly 28 on the mid-mounted bearing mounting seat. The mid-mounted bearing mounting seat, as a key component connecting the motor side and the pneumatic part, is provided with an avoidance round hole in the center through which the rotor passes, so the internal circulating holes 22 isn't completely vertically distributed as expected. The circulating holes 22 are designed to be V-shaped, arc-shaped, or linear in the present disclosure, so that the circulating holes 22 pass through the bearing mounting seat as much as possible while avoiding the avoidance round hole to improve the cooling effect. The structural form of the internal circulating holes 22 is also not limited to the above-mentioned concentrated form, and the shape and number of the fluid channels can be designed correspondingly by a designer according to actual applications.

In addition, as the pneumatic part of the air compressor is constantly operating compressed air to do work, the temperature in a pneumatic cavity gradually rises, and the rising temperature can be transferred to the motor side through the metal casing of the air compressor, which is not conducive to heat dissipation on the motor side of the compressor. The mid-mounted bearing mounting seat with the cyclic cooling flow channels serves as a barrier, which obstructs the heat generated by the pneumatic part from being transferred to the motor side of the compressor by using its cooling effect to ensure the cooling of the motor side of the compressor.

The radial air bearing 25 located at the first end of the rotor 3 is arranged on a side of the thrust disc 4 away from the axial bearing assembly 28, and an axial displacement sensor 26 is arranged on an end side of the radial air bearing 25 facing the thrust disc 4, which, in combination with the above-mentioned solution that the radial displacement sensor 11 is provided on the inner peripheral side of the fixing seat 5 and the radial displacement sensor 11 faces the outer peripheral face of the thrust disc 4, achieves that the detection of both radial and axial displacements of the rotor 3 is carried out by means of one part, i.e. the thrust disc 4.

As the air compressor supported by the air bearings is a turbomachine operating at a high speed and with high precision, the rotor needs to be monitored in real time in the development and testing stage or some special occasions, and the performance and dynamic stability of the bearings are determined by determining a moving trajectory of the rotor at different speeds and in different working conditions. In order to achieve dynamic monitoring of the rotor of the air compressor supported by the air bearings, in the present disclosure, improvements and adjustments are made on the radial air bearing close to the axial bearing assembly 28 and the mid-mounted axial bearing seat. Firstly, the size of the side of the axial bearing assembly 28 close to the pneumatic part is increased, and two counter bores are formed, on the side of the axial bearing assembly 28 close to the pneumatic part, as rotor axial displacement sensor mounting positions for arranging the rotor axial displacement sensor 26 to monitor the axial condition when the rotor is operating, and two counter bores distributed symmetrically or four counter bores in cross-like distribution are formed in the radial direction, in the inner peripheral wall of the fixing seat 5 for the axial bearing seat, as rotor radial displacement sensor mounting positions for arranging the radial displacement sensor 11 to monitor the moving trajectory of the axis when the rotor is operating. Furthermore, the outer circle of the thrust disc 4, after being subjected to precision machining, is used as a rotor radial displacement monitoring surface, and similarly, an end side of the thrust disc 4 that does not cooperate with the axial bearing assembly 28, after being subjected to precision machining, is used as a rotor axial displacement monitoring surface. Both the rotor radial displacement monitoring surface and the rotor axial displacement monitoring surface are provided on the thrust disc 4, so errors arising from machining the rotor shaft system parts and assembling different shaft system parts to each other, as well as influences of bending and deformation the rotor are reduced, and the monitoring accuracy is improved.

In description of the present disclosure, it needs to be appreciated that orientation or position relations denoted by the terms "center", "longitudinal", "transverse", "front", "rear", "left", "right", "vertical", "horizontal", "top', "bottom", "inner", "outer" and the like are orientation or position relations illustrated based on the drawings, are merely for the convenience of describing the present disclosure and simplifying description, instead of indicating or implying the denoted devices or elements must have specific orientations or be constructed and operated in specific orientations, and thus the terms cannot be construed as limiting the protection scope of the present disclosure.

Finally, it should be noted that the above embodiments are only used for describing rather than limiting the technical solutions of the present disclosure. Although the present disclosure is described in detail with reference to the preferred embodiments, those of ordinary skill in the art should understand that they still can make modifications to the specific implementations in the present disclosure or make equivalent substitutions to part of technical features thereof; and such modifications and equivalent substitutions should be encompassed within the scope of the technical solutions sought for protection in the present disclosure so long as they do not depart from the spirit of the technical solutions of the present disclosure.

The invention claimed is:

1. A compressor, comprising:

a drive motor comprising a casing and a rotor, the rotor being rotatably arranged within the casing;

a wind wheel mounted at a first axial end of the rotor;

a thrust disc, the thrust disc being arranged at the first axial end of the rotor; and an axial bearing assembly fixed to the casing, the axial bearing assembly being arranged between the thrust disc and the wind wheel, wherein a first air gap is formed between the axial bearing assembly and the wind wheel, and a second air gap is formed between the axial bearing assembly and the thrust disc;

wherein the axial bearing assembly comprises;

an annular fixing seat fixed to the casing;

an annular bearing seat arranged on an inner peripheral wall of the fixing seat;

a first axial bearing arranged at a first axial end of the bearing seat; and a second axial bearing arranged at a second axial end of the bearing seat, wherein the first air gap is formed between the first axial bearing and the wind wheel, and the second air gap is formed between the second axial bearing and the thrust disc;

wherein an axial dimension of the bearing seat is smaller than an axial dimension of the fixing seat, and the bearing seat is located in the middle of the fixing seat in the axial direction; and the first axial end of the bearing seat and the inner peripheral wall of the fixing seat form a first annular slot, and the first axial bearing is mounted in the first annular slot.

2. The compressor according to claim 1, wherein the wind wheel is at least partially mounted into the first annular slot and is in annular seal fit with the inner peripheral wall of the fixing seat.

3. The compressor according to claim 1, wherein the second axial end of the bearing seat and the inner peripheral wall of the fixing seat form a second annular slot, and the second axial bearing is mounted in the second annular slot.

4. The compressor according to claim 3, wherein the diameter of the thrust disc is smaller than or equal to the diameter of the second annular slot, and the thrust disc is at least partially mounted in the second annular slot.

5. The compressor according to claim 1, further comprising:

a radial displacement sensor arranged on the inner peripheral wall of the fixing seat, the radial displacement sensor being configured to detect a radial displacement of the rotor by detecting a radial displacement of the thrust disc.

6. The compressor according to claim 1, wherein the wind wheel comprises an axial flange projecting towards the thrust disc, and the thrust disc comprises a first positioning surface facing the axial bearing assembly; and the axial flange is arranged on an inner peripheral side of the axial bearing assembly, and a positioning end side of the axial flange facing the thrust disc abuts against the first positioning surface.

7. The compressor according to claim 1, further comprising:

a mounting shaft arranged at the first axial end of the rotor, the wind wheel being mounted to the mounting shaft.

8. The compressor according to claim 7, further comprising:

a positioning boss arranged at the first axial end of the rotor, wherein the mounting shaft is located on the positioning boss; the diameter of the positioning boss is smaller than the diameter of the rotor, and the diameter of the mounting shaft is smaller than the diameter of the positioning boss; and the thrust disc is mounted on the positioning boss, and an axial dimension of the positioning boss is smaller than an axial dimension of the thrust disc.

9. The compressor according to claim 1, further comprising:

a volute, the wind wheel being enclosed by the volute outside, and an impeller diffuser arranged on a side of the fixing seat facing the volute, wherein the impeller diffuser cooperates with the volute to form pneumatic flow channels.

10. The compressor according to claim 9, wherein a mounting step is provided at a radial end of the fixing seat, and the volute is mounted on the mounting step.

11. The compressor according to claim 1, wherein cooling flow channels are formed in the axial bearing assembly, the cooling flow channels comprising a first fluid passage port, a second fluid passage port and a circulating hole, the first fluid passage port and the second fluid passage port being communicated through the circulating hole.

12. The compressor according to claim 11, wherein the first fluid passage port and the second fluid passage port are provided in the fixing seat, and the circulating holes pass through the fixing seat and/or the bearing seat.

13. The compressor according to claim 11, wherein there are a plurality of circulating holes, the plurality of the circulating holes being communicated with the first fluid passage port through a first communicating channel, the plurality of the circulating holes being communicated with the second fluid passage port through a second communicating channel, the first communicating channel and the second communicating channel being isolated from each other.

14. The compressor according to claim 13, wherein the first fluid passage port and the second fluid passage port both extend axially of the fixing seat, and the circulating holes extend radially of the fixing seat, and the first communicating channel and the second communicating channel are both provided on an outer peripheral side of the fixing seat.

15. The compressor according to claim 13, wherein the first communicating channel is located on an outer peripheral side of the circulating holes and extends circumferentially of the fixing seat; the second communicating channel is located on the outer peripheral side of the circulating hole and extends circumferentially of the fixing seat; and the first communicating channel is located at a first radial end of the fixing seat and the second communicating channel is located at a second radial end of the fixing seat.

16. The compressor according to claim 13, wherein the first communicating channel is configured as an open slot formed on an outer peripheral face of the fixing seat, and/or the second communicating channel is configured as an open slot formed on the outer peripheral face of the fixing seat.

17. The compressor according to claim 11, wherein the circulating hole is configured to be V-shaped, arc-shaped or linear.

18. The compressor according to claim 1, further comprising:

two radial air bearings, each of the radial air bearing being arranged at one end axially of the rotor, the rotor being rotatably sleeved in the radial air bearings.

* * * * *